US009498673B2

(12) United States Patent
Tung

(10) Patent No.: US 9,498,673 B2
(45) Date of Patent: Nov. 22, 2016

(54) EXERCISE DEVICE WITH SWING FUNCTION

(71) Applicant: SINGULARITY LTD., Belize (BZ)

(72) Inventor: Chia Lin Tung, Taichung (TW)

(73) Assignee: Singularity Ltd., Belize (BZ)

( * ) Notice: Subject to any disclaimer, the term of this patent is extended or adjusted under 35 U.S.C. 154(b) by 27 days.

(21) Appl. No.: 14/676,997

(22) Filed: Apr. 2, 2015

(65) Prior Publication Data

US 2016/0287931 A1 Oct. 6, 2016

(51) Int. Cl.
*A63B 69/16* (2006.01)
*A63B 22/06* (2006.01)

(52) U.S. Cl.
CPC ..... *A63B 22/06* (2013.01); *A63B 2225/093* (2013.01)

(58) Field of Classification Search
USPC ..... 482/1–148; 248/346.03
See application file for complete search history.

(56) References Cited

U.S. PATENT DOCUMENTS 3,089,699 A * 5/1963 Flesch ..... A63G 11/00 472/113
3,760,423 A * 9/1973 Kuecken ..... H01Q 1/20 248/624
4,863,163 A * 9/1989 Wehrell ..... A63B 21/4009 482/123
5,277,675 A * 1/1994 Shifferaw ..... A63B 5/08 482/142
5,387,166 A * 2/1995 Gvoich ..... A63B 5/08 482/26
6,132,338 A * 10/2000 Shifferaw ..... A63B 5/08 482/30
6,322,480 B1 * 11/2001 Lim ..... A63B 26/003 472/103
6,926,643 B1 * 8/2005 Gvoich ..... A63B 23/0458 482/51
7,326,151 B2 * 2/2008 Peterson ..... A63B 22/16 482/57
7,438,672 B1 * 10/2008 Rylander ..... A63B 22/0605 446/396
7,481,746 B2 * 1/2009 Ibarguren ..... A63B 22/0605 482/57
7,927,258 B2 * 4/2011 Irving ..... A63B 21/015 482/51
2002/0055422 A1 * 5/2002 Airmet ..... A63B 22/16 482/61
2010/0288901 A1 * 11/2010 Wallach ..... A63B 22/0076 248/346.03
2012/0071301 A1 * 3/2012 Kaylor ..... A63B 21/00058 482/57

FOREIGN PATENT DOCUMENTS

TW M481759 7/2014

* cited by examiner

*Primary Examiner* — Stephen Crow
(74) *Attorney, Agent, or Firm* — Rosenberg, Klein & Lee

(57) ABSTRACT

An exercise device with a swing function includes a main body and a plurality of support mechanisms. The main body has a base which includes a front part and a back part. Each of the plurality of support mechanisms has a height and is abutted upon a ground to sustain the base. The height of each of the plurality of support mechanisms is changeable. When the main body is controlled to drive the base, the base stresses each of the plurality of support mechanisms to change its height. Therefore, the main body can be inclined to any direction to form a swing motion.

4 Claims, 10 Drawing Sheets

EXERCISE DEVICE WITH SWING FUNCTION

1. FIELD OF THE INVENTION

The present disclosure relates to an exercise device, and more particularly to an exercise device capable of producing a swing motion from the left to right with respect to the ground.

2. DESCRIPTION OF THE RELATED ART

As we all know, doing exercise is an important way to promote human's health. Furthermore, apart from promoting the health, doing exercise can also help to shape human's body curve. As a result, the exercise atmosphere becomes very popular in current society. Most of modern people just have free time at night because of busy life, but many factors are detrimental for doing exercise at night. For example, night temperature is lower, respiration of plants at night leads oxygen content in the atmosphere to be lower, a lot of crime may be existed at night and so on. Thus, indoor exercise equipment gets people's lots of attractions because people can use the exercise equipment to do exercise at home or at a gymnasium.

In a traditional indoor exercise equipment such as an exercise bike, a bike body is fixed on a base to allow a user for treading. However, in the aforesaid structure the bike body is stayed immovably during the treading process, so the user may miss a real riding experience and feel bored during the exercise, and it results in reducing the pleasure of the exercise.

Thus, how to solve the above problems becomes a major issue in the present disclosure.

SUMMARY OF THE INVENTION

The major objective of the present disclosure is to provide an exercise device with a swing function, and the exercise device includes elastic support mechanisms at the left part and the right part of the bottom thereof. During operation of the exercise device, heights of the left part and the right part from the ground may be changed accordingly, so as to produce a swing motion.

In order to achieve the above objective, the present disclosure is to provide an exercise device with a swing function, and the exercise device includes a main body and a plurality of support mechanisms.

The main body has a base which includes a front part and a back part.

The plurality of support mechanisms which are disposed on the front part and the back part respectively, and each of the plurality of support mechanisms has a height and is abutted upon a ground to support the base. The height of each of the plurality of support mechanisms is changeable. When the main body is controlled to drive the base, the plurality of support mechanisms are forced by the base to change the heights thereof respectively, such that the main body can be inclined to any direction to produce a swing motion.

In one embodiment, each of the support mechanisms has a fixed member and an elastic member. The fixed member is fastened with the base. The elastic member is linked to the fixed member at an end thereof and abutted upon the ground at other end thereof. The motion of the base enables deformation of the elastic member to change the height of the elastic member, so as to change the height of the support mechanism.

In another embodiment, the support mechanism has a fixed cylinder, a first elastic member, a support cylinder and a foundation. The fixed cylinder is fastened with the base and has a hollow space therein. The foundation is abutted upon the ground, and the support cylinder is pivoted on the foundation and inserted into the hollow space. The first elastic member is disposed in the hollow space. The first elastic member is abutted upon a top surface of the fixed cylinder at an end thereof and abutted upon the support cylinder at other end thereof. The motion of the base enables deformation of the first elastic member to change a height of the first elastic member, so as to change the height of the support mechanism.

Furthermore, the base has support parts at the front part and the back part thereof respectively. Each of the support part has an arc-shaped bottom abutted upon the ground, and a position where the ground abuts the bottom is defined as a pivot. With the swing motion of the base to the left and right, the position of the pivot on the bottom of the support part is changed accordingly.

The above objectives and advantages of the present disclosure can have a gain insight easily by choosing from the detailed description and the accompanying drawings in the following embodiments.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

DETAILED DESCRIPTION OF THE PREFERRED EMBODIMENTS

Figure 1:
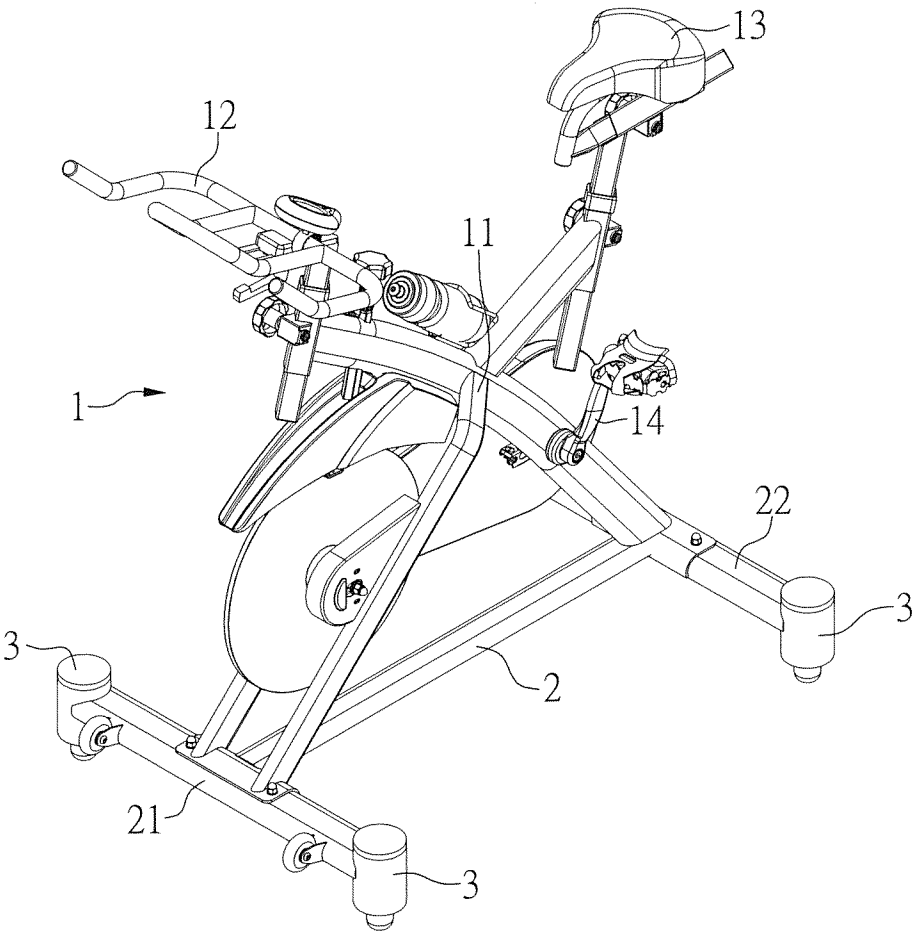
FIG. 1 shows a perspective view of an exercise device according to a first embodiment of the present disclosure.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

Please refer to FIG. 1 which shows a perspective view of an exercise device with a swing motion according to the first embodiment of the present disclosure. A main body 1 of the exercise device is shown in the FIG. 1. In the present disclosure, the main body 1 may be any type of the exercise device, and the exercise bike is just taken as example for illustration. In the present embodiment, the main body 1 includes a support frame 11, and the support frame 11 includes a handle 12, a seat 13 and a rotating mechanism 14 which is driven by treading. A user can sit on the seat 13, hold the handle 12 by hand, and tread the rotating mechanism 14 by feet at the same time, so as to obtain an effect of exercising.

The main body 1 has a base 2, and a front part 21 and a back part 22 are defined in the base 2. Support mechanisms 3 are mounted on the front part 21 and the back part 22 respectively. In the present embodiment, the support mechanisms 3 are provided on a left part and a right part of the front part 21 and the back part 22, respectively. Each of the support mechanisms 3 is abutted upon the ground and has a height, and the base 2 is sustained by the support mechanisms 3 from the ground by a distance. The heights of the support mechanisms are changeable. Therefore, when the user controls the main body 1 to produce motion, the base 2 is driven to force the height of each support mechanism to be changed. Then the main body 1 can be inclined to any direction to produce a swing motion.

Figure 2:
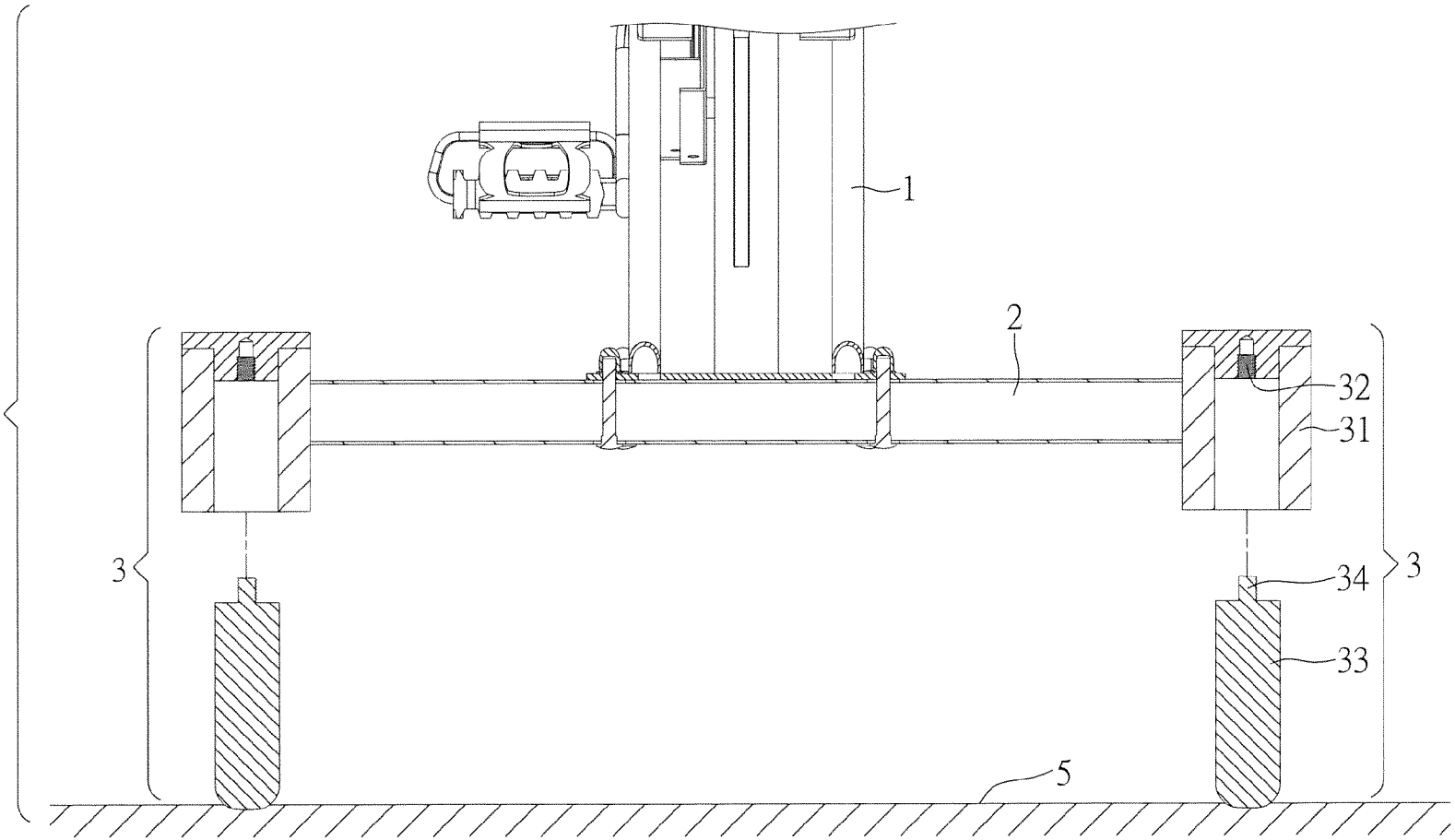
FIG. 2 shows a sectional exploded view of the exercise device according to the first embodiment of the present disclosure.

The detailed structure of the support mechanism 3 is shown in FIG. 2, and the support mechanism 3 includes a fixed member 31 and an elastic member. The fixed member 31 is fastened with the base 2 and the fixed member 31 has a threaded hole 32. In the present embodiment, the elastic member is an elastic column 33 which is made of elastic material, and has a deformable characteristic. A threaded bolt 34 is extended from an end of the elastic column 33, and the threaded bolt 34 is used to be screwed to the threaded hole 32 of the fixed member 31. The elastic column 33 is abutted upon the ground 5 at other end thereof.

Figure 3:
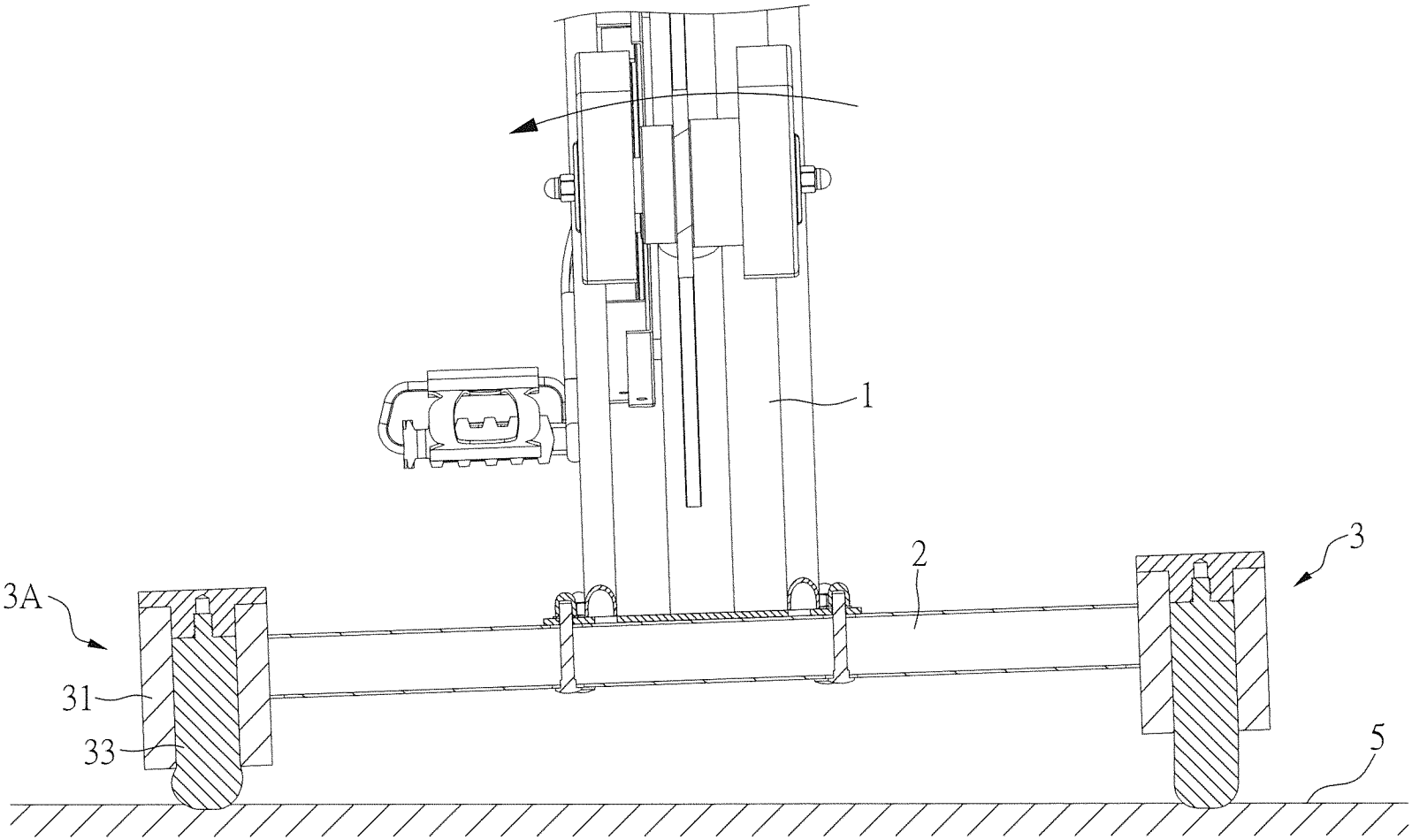
FIG. 3 shows a sectional view of a working status of the exercise device according to the first embodiment of the present disclosure.

By the above structure, the base 2 is driven when the user controls the main body to have an exercise. For example, when the user controls the main body 1 to incline to the left, as shown in FIG. 3, the base 2 is inclined to the left to stress the support mechanism 3A disposed at the left part of the base 2. At this moment, the elastic column 33 of the stressed support mechanism 3A is compressed to reduce the height thereof, and it results in a height reduction of the support mechanism 3A. Therefore, the height of the left part of the base 2 being sustained with respect to the ground is reduced, and the main body 1 is inclined to the left successfully. On the other hand, the manner of inclining the main body 1 to the right is equal to that of inclining the main body 1 to the left, so the detail description is omitted here. According to the exercise device of this embodiment, the main body 1 may be inclined to any direction to produce a swing motion.

Figure 4:
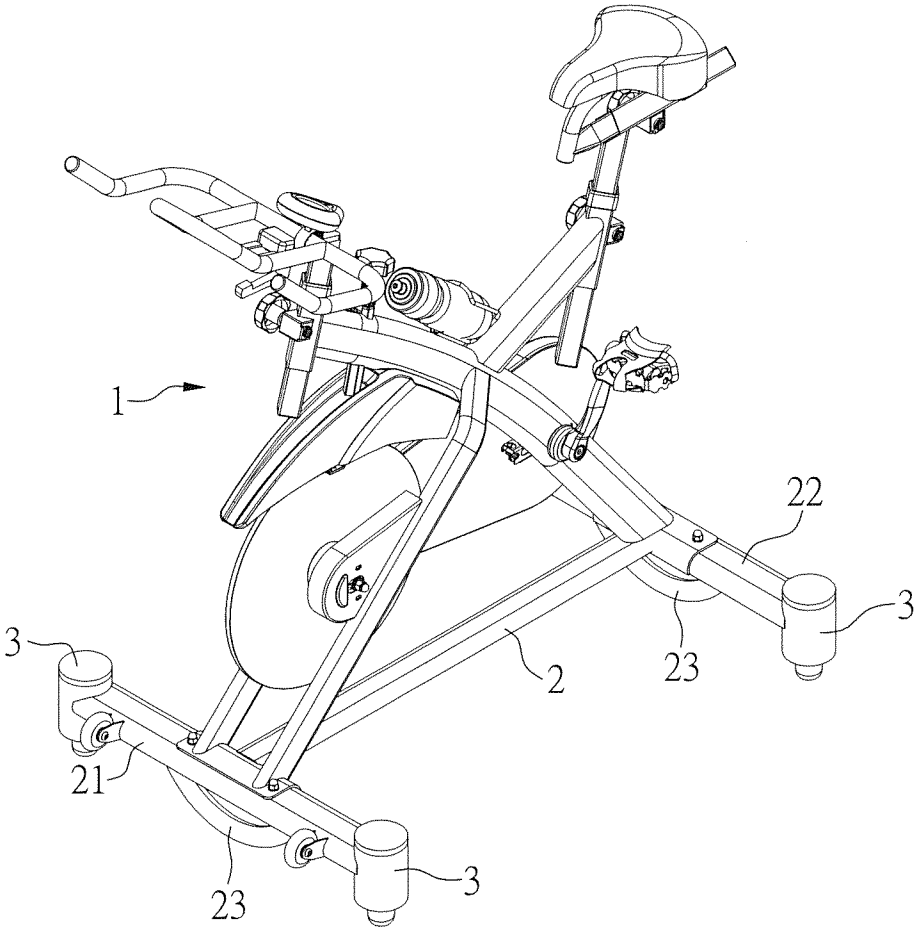
FIG. 4 shows a perspective view of the exercise device according to a second embodiment of the present disclosure.
Figure 5:
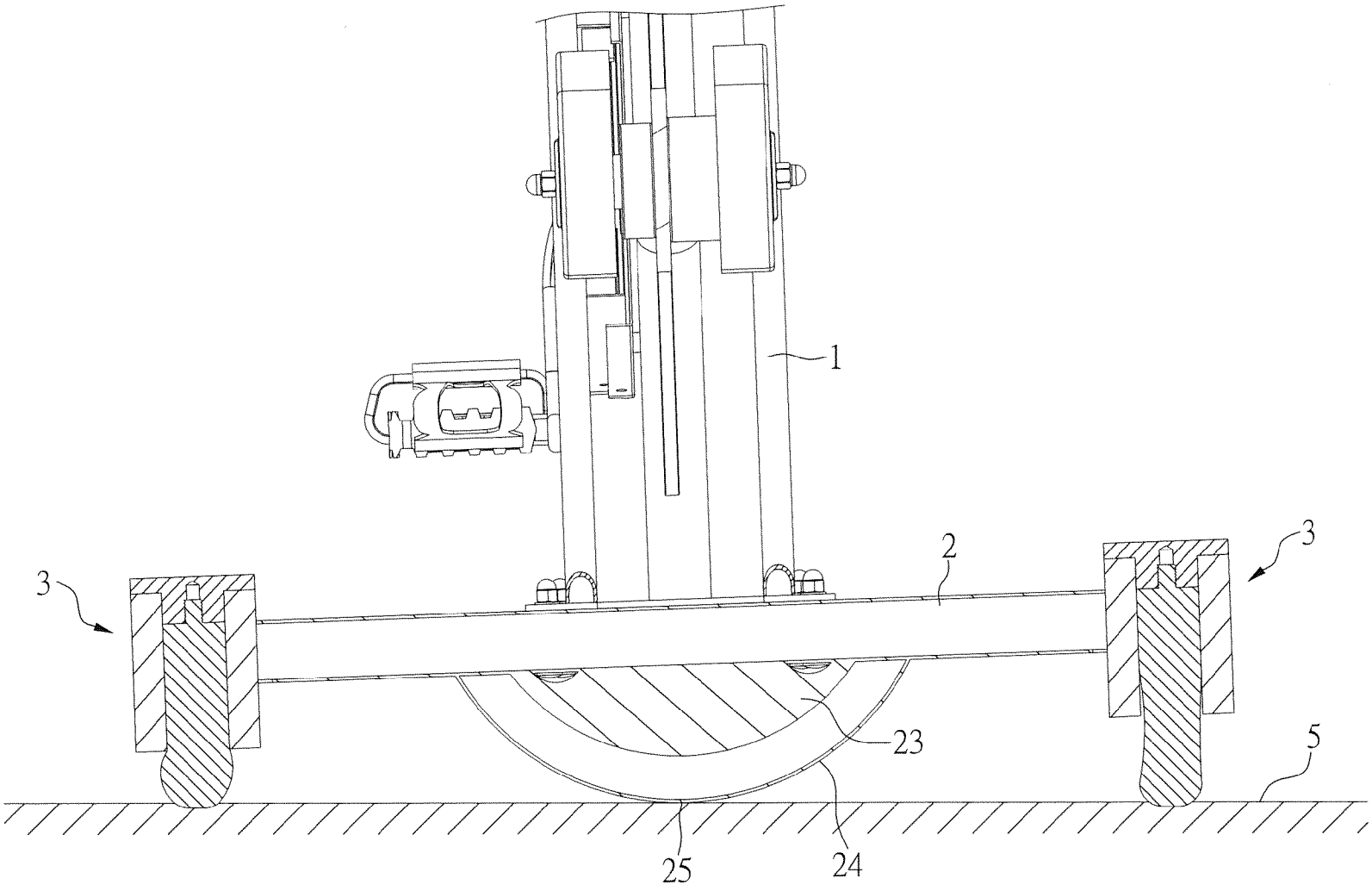
FIG. 5 shows a sectional view of the working status of the exercise device according to the second embodiment of the present disclosure.

FIG. 4 and FIG. 5 show a second embodiment of the present disclosure. The difference between the second present embodiment and the first embodiment is that support parts 23 are additionally disposed at the front part 21 and the back part 22 of the base 2 respectively. The support part 23 has an arc-shaped bottom 24 abutted upon the ground 5, and a position where the bottom 24 is abutted with the ground 5 is defined as a pivot 25. With the swing motion of the main body 1 controlled by the user in the above description, the support part 23 can be rolled on the ground 5 via the arc-shaped bottom 24 thereof, so the position of the pivot 25 on the bottom 24 is changeable. In the present embodiment, the capability of sustaining the main body 1 and the base 2 can be enhanced by the support part 23.

Figure 6:
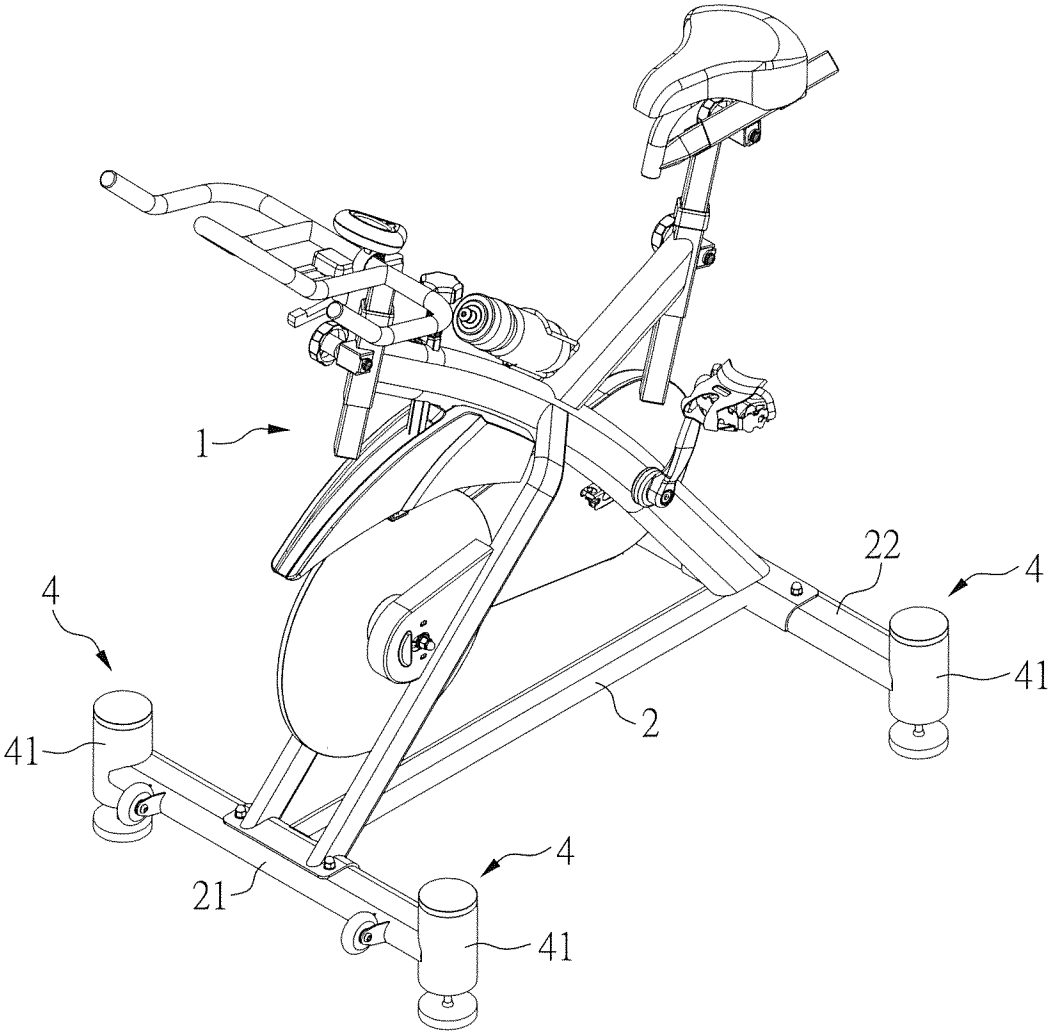
FIG. 6 shows a perspective view of the exercise device according to a third embodiment of the present disclosure.
Figure 7:
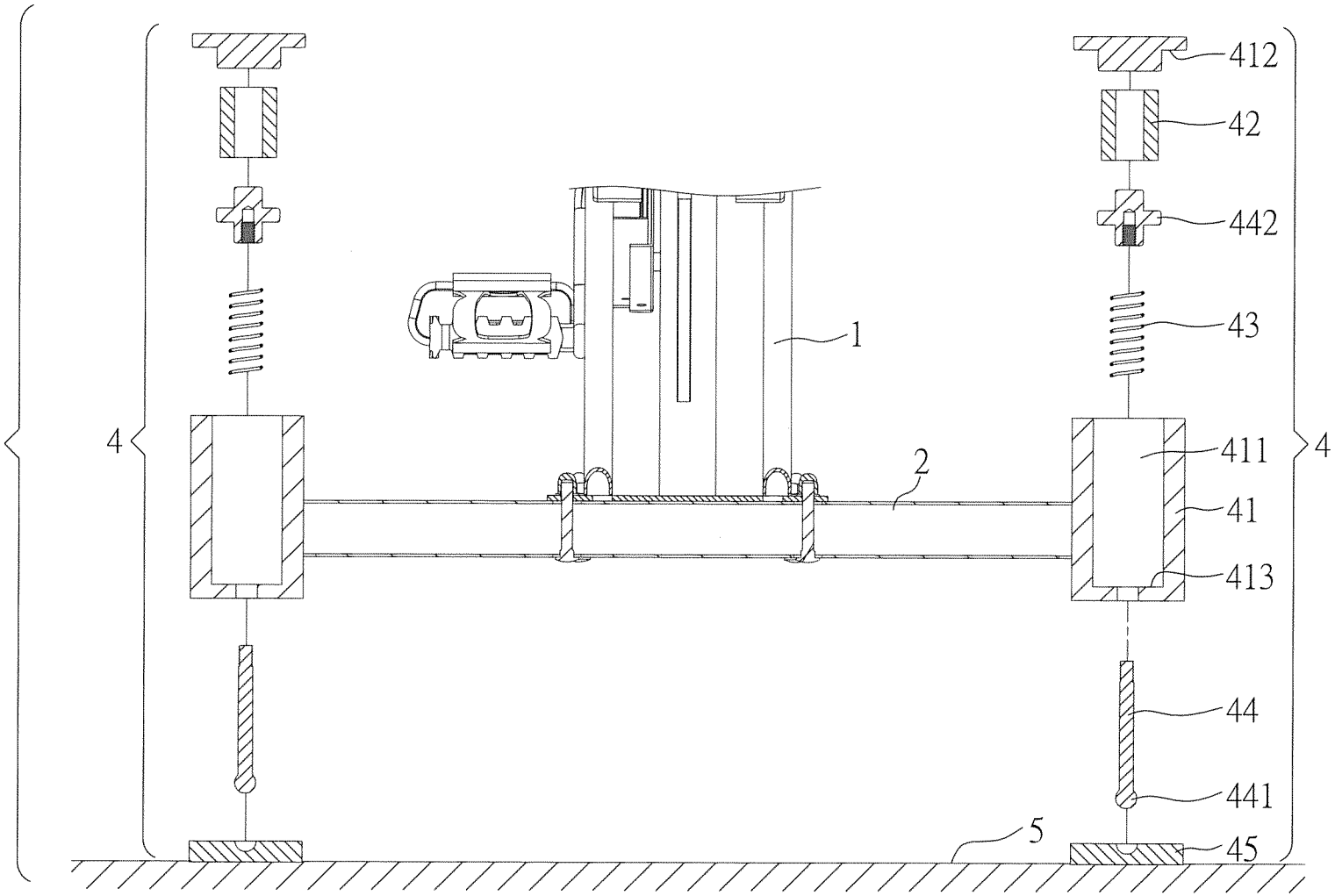
FIG. 7 shows a sectional exploded view of the exercise device according to the third embodiment of the present disclosure.

The present disclosure further provides a third embodiment as shown in FIG. 6 and FIG. 7. The difference between the third embodiment and the first embodiment is the change in the support mechanism. The other parts of the third embodiment are the same as that of the first embodiment. The support mechanism 4 of the third embodiment has a fixed cylinder 41, a first elastic member 42, a second elastic member 43, a support cylinder 44 and a foundation 45. The fixed cylinder 41 includes a hollow space 411 therein and the fixed cylinder 41 is fastened with the base 2. In the embodiment, the fixed cylinders 41 are disposed on the left part and the right part of the front part 21 and the back part 22 of the base 2, respectively. On the other hand, the foundation 45 is disposed on the ground 5, and the support cylinder 44 is pivoted on the foundation 45. The support cylinder 44 has a spherical pivot part 441 at a bottom thereof, and the support cylinder 44 is pivoted on the foundation 45 via the spherical pivot part 441. Therefore, the support cylinder 44 can perform a universal pivoting towards any direction with respect to the foundation 45.

A top end of the support cylinder 44 is extended into the hollow space of the fixed cylinder 41, and an abutting block 442 is disposed at the top end. A first elastic member 42 and a second elastic member 43 are disposed at both sides of the abutting block 442 in the hollow space 411, and the first elastic member 42 is abutted with atop surface 412 of the fixed cylinder 411 at one end thereof and abutted with the abutting block 442 at other end thereof. The second elastic member 43 is sleeved outside of the support cylinder 44, and the second elastic member 43 is abutted with a bottom 413 of the fixed cylinder 41 at an end thereof and abutted with the abutting block 442 at other end thereof. In the present embodiment, the first elastic member 42 has an elastic structure made of elastic materials, the second elastic member 43 is a spring, and both them can be deformed to change heights thereof. According to the structure, the support mechanism 4 can be abutted upon the ground 5 via the foundation 45, and the base 2 is sustained by using the support cylinder 44 and two elastic members 42 and 43 to sustain the fixed cylinder 41.

Figure 8:
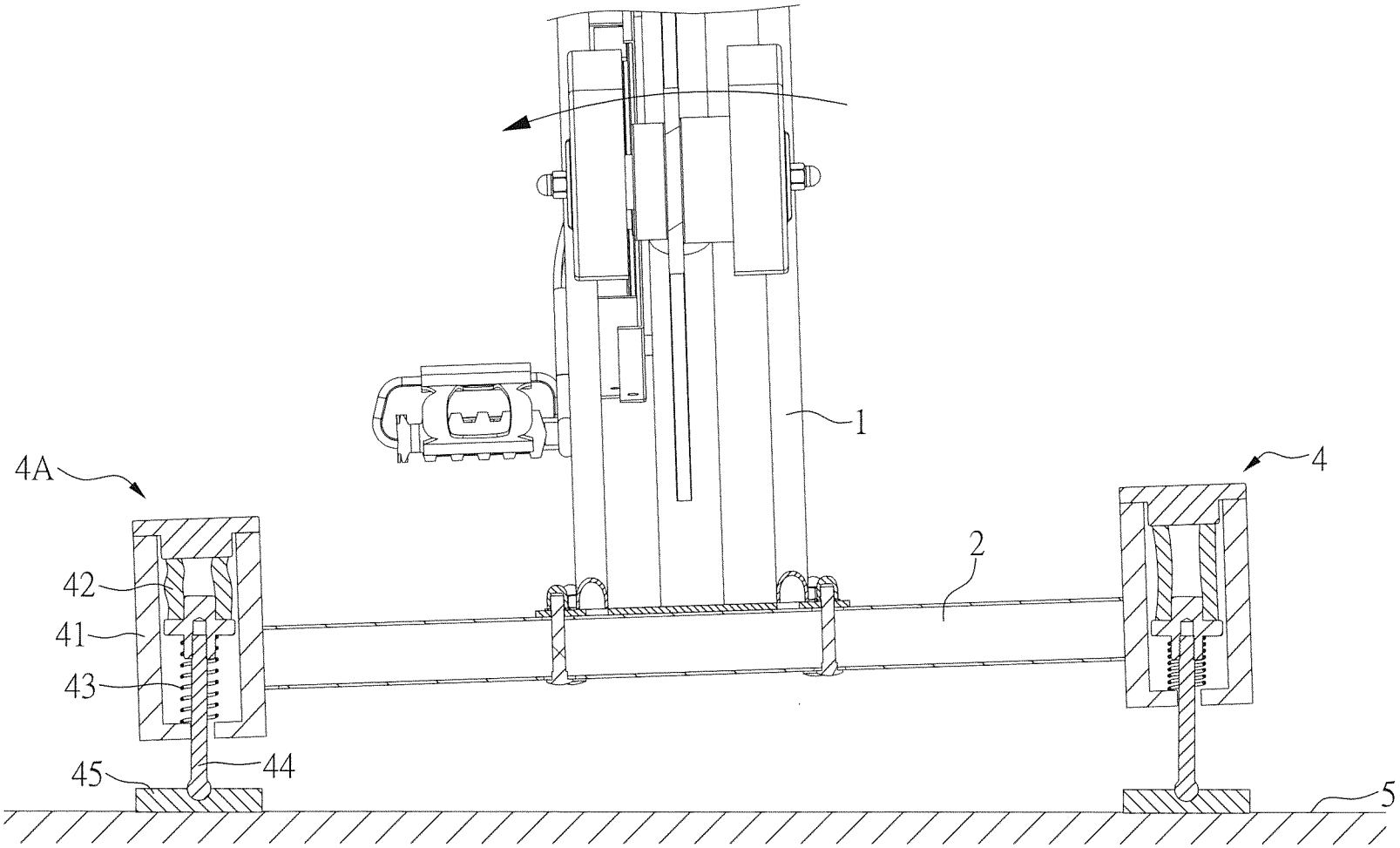
FIG. 8 shows a sectional view of a working status of the exercise device according to the third embodiment of the present disclosure.

When the user controls the main body to do exercise, the base 2 is driven correspondingly. For example, when the user controls the main body 1 to incline to the left, as shown in FIG. 8, the base 2 is forced to incline to the left and then stresses the support mechanism 4A disposed at the left part of the base 2. At this moment, in the stressed support mechanism 4A, the fixed cylinder 41 compresses the first elastic column 42 to reduce the height of the first elastic member 42, and it results in a height reduction of the support mechanism 4A, and the height of the left end of the base 2 being sustained with respect to the ground is further reduced, whereby the main body 1 is inclined to the left successfully. On the other hand, the manner of inclining the main body 1 to the right is equal to the one of inclining the main body 1 to the left, so the detailed description is omitted. According to the exercise device, the main body 1 can be inclined to any direction to produce a swing motion.

Figure 9:
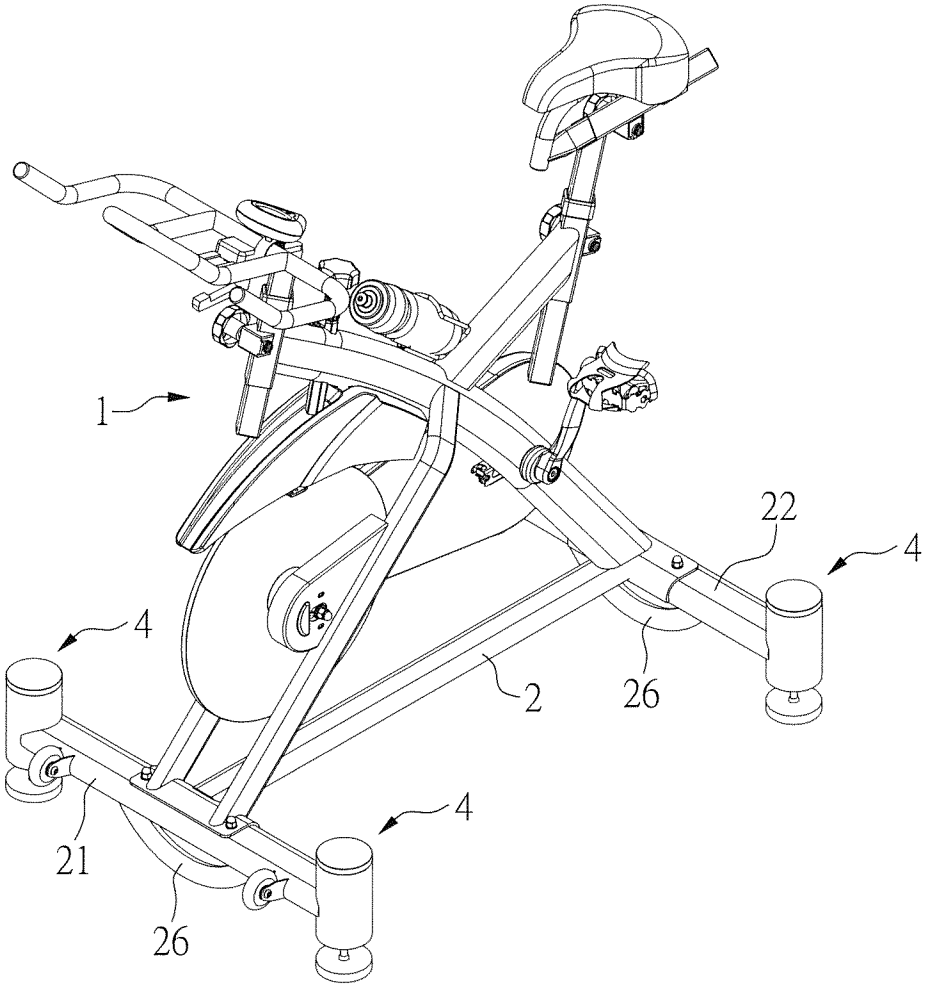
FIG. 9 shows a perspective view of the exercise device according to a fourth embodiment of the present disclosure.
Figure 10:
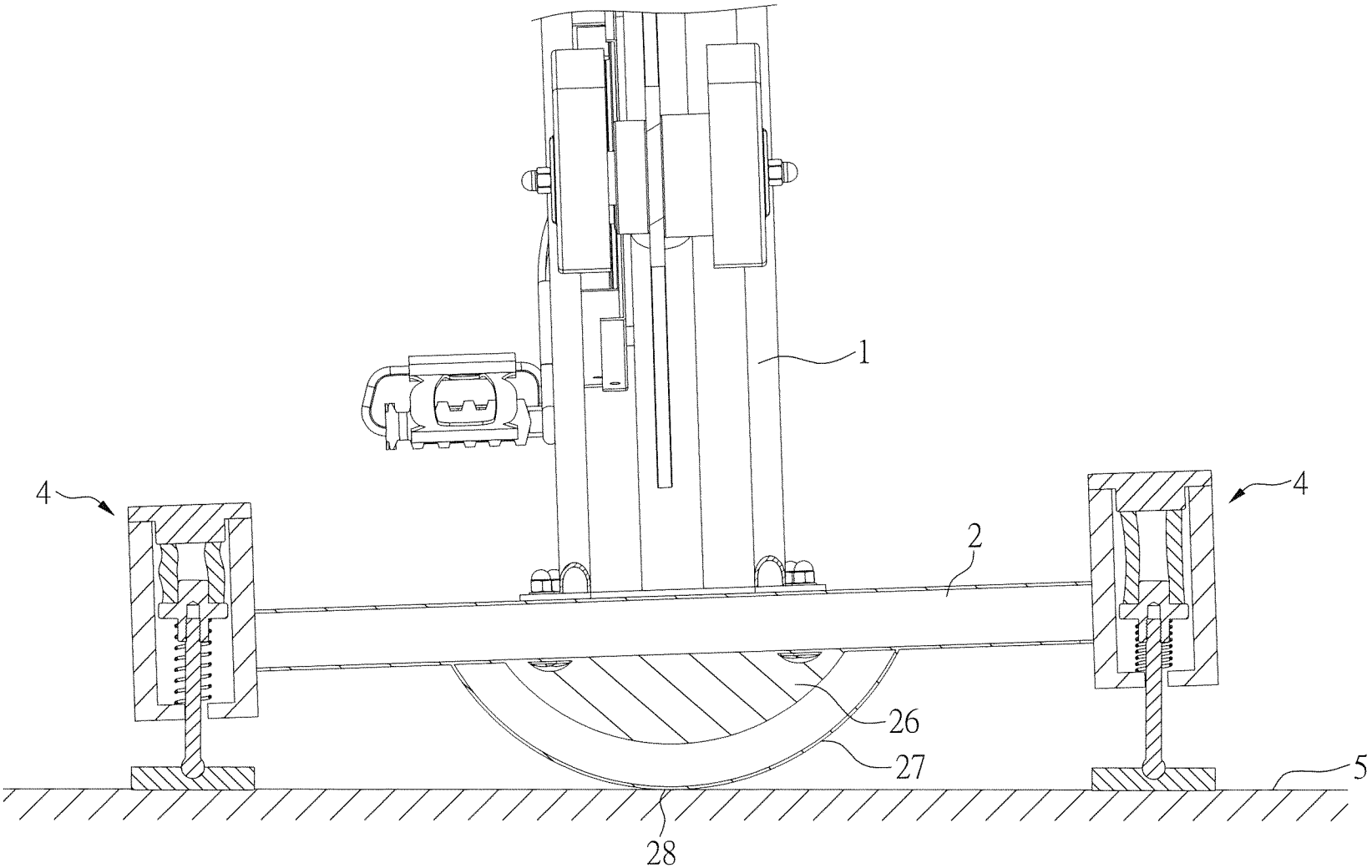
FIG. 10 shows a sectional view of the working status of the exercise device according to the fourth embodiment of the present disclosure.

In addition, FIG. 9 and FIG. 10 show a fourth embodiment of the present disclosure. A difference between the fourth embodiment and the third embodiment is that support parts 26 are additionally disposed on both the front part 21 and the back part 22 of the base 2 of the third embodiment, respectively. Each of the support parts 26 has an arc-shaped bottom 27 abutted upon the ground 5, and a position where the bottom 27 is abutted upon the ground 5 is defined as a pivot 28. With the swing motion of the main body 1 controlled by the user in the above description, the support part 26 can be rolled on the ground 5 via the arc-shaped bottom 27, so the position of the pivot 28 on the bottom 27 is changeable. In the present embodiment, the capability of sustaining the main body 1 and the base 2 can be may enhanced by the support parts 26.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

The invention claimed is:

1. An exercise device with a swing motion, comprising:

a main body having a base which includes a front part and a back part; and a plurality of support mechanisms disposed on the front part and the back part respectively, each of the plurality of support mechanisms having a height and disposed upon a support surface to sustain the base;

wherein each of the plurality of support mechanisms is changeable in height, and when the main body is controlled to drive the base, the base forces the plurality of support mechanisms to change in height respectively, so that the main body is inclined to any direction in a swing motion;

wherein the main body includes a support frame having a handle, a seat and a rotating mechanism driven by treading wherein the support mechanism includes a fixed cylinder, a first elastic member, a support cylinder and a foundation, the fixed cylinder is fastened with the base, and the fixed cylinder includes a hollow space therein, the foundation is disposed upon the support surface, and the support cylinder is pivoted on the foundation and is extended into the hollow space, the first elastic member is disposed in the hollow space and abuts a top surface of the fixed cylinder at an end thereof and abuts the support cylinder at another end thereof, the motion of the base enables deformation of the first elastic member to change in height and thereby change the support mechanism in height.

2. The exercise device of claim 1, wherein both the front part and the back part of the base include support parts respectively, the support part includes an arc-shaped bottom abutted upon the support surface, a position where the support surface abuts the bottom is defined as a pivot, and the position of the pivot on the bottom of the support part is changed according to the swing motion of the base.

3. The exercise device of claim 1, wherein the support mechanism further includes a second elastic member which is disposed in the hollow space and sleeved outside of the support cylinder, and the second elastic member abuts a bottom surface of the fixed cylinder at an end thereof and abuts the support cylinder at another end thereof.

4. The exercise device of claim 1, wherein both the front part and the back part of the base include support parts respectively, each of the support parts includes an arc-shaped bottom abutted upon the support surface, and a portion of the bottom is contacting the support surface defining a pivot, the position of the pivot on the bottom of the support part changing laterally according to the swing motion of the base.

* * * * *